US006154243A

United States Patent [19]

Tatewaki et al.

[11] Patent Number: 6,154,243

[45] Date of Patent: Nov. 28, 2000

[54] REVERSIBLE THERMAL RECORDING METHOD AND APPARATUS THEREFOR

[75] Inventors: Tadafumi Tatewaki; Hiromi Furuya, both of Shizuoka-ken; Fumio Kawamura, Shizuoka; Atsushi Kutami, Numazu; Kyoji Tsutsui, Mishima; Masafumi Torii, Shizuoka; Masaru Shimada, Shizuoka-ken; Hiroaki Matsui, Numazu, all of Japan

[73] Assignee: Ricoh Company, Ltd., Tokyo, Japan

[21] Appl. No.: 09/217,348

[22] Filed: Dec. 21, 1998

[30] Foreign Application Priority Data

Dec. 27, 1997 [JP] Japan ..... 9-369173
Dec. 18, 1998 [JP] Japan ..... 10-360317

[51] Int. Cl.[7] ..... B41J 2/375

[52] U.S. Cl. ..... 347/223; 347/185; 347/186

[58] Field of Search ..... 347/171, 179, 347/185, 186, 187, 215, 221, 223

[56] References Cited

U.S. PATENT DOCUMENTS

| | | | |
|---|---|---|---|
| 4,891,652 | 1/1990 | Sato et al. | 347/219 |
| 5,274,460 | 12/1993 | Yamada et al. | 358/296 |
| 5,641,724 | 6/1997 | Yamaguchi et al. | 503/221 |
| 5,703,005 | 12/1997 | Torii et al. | 503/201 |
| 5,747,413 | 5/1998 | Amano et al. | 503/201 |
| 5,817,599 | 10/1998 | Iida et al. | 503/209 |
| 5,946,019 | 8/1999 | Suzuki et al. | 347/171 |

FOREIGN PATENT DOCUMENTS

| | | |
|---|---|---|
| 0492628 | 7/1992 | European Pat. Off. . |
| 2591534 | 6/1987 | France . |
| 195 07 151 | 9/1995 | Germany . |
| 2320582 | 6/1998 | United Kingdom . |
| 2326726 | 12/1998 | United Kingdom . |

OTHER PUBLICATIONS

Patent abstracts of Japan (European Patent Office), abstract of Japan Pub. No. 08090934 (Apr. 1996).

*Primary Examiner*—N. Le
*Assistant Examiner*—Anh T. N. Vo
*Attorney, Agent, or Firm*—Cooper & Dunham LLP

[57] ABSTRACT

A reversible thermal recording method using a color/non-color type reversible thermosensitive recording material which has a recording layer formed overlying at least one side of a substrate and including an electron donating coloring agent and an electron accepting color developer and which reversibly forms a colored state and a non-colored state by being appropriately heated and cooled. The recording layer having images of the colored state which have been formed in the recording layer is heated to erase the image, and imagewise heated either at substantially the same time as, or after, the image erasing operation to record new images therein, and then relatively rapidly cooled to maintain the new images. A reversible thermal recording apparatus therefor is also provided.

28 Claims, 4 Drawing Sheets

REVERSIBLE THERMAL RECORDING METHOD AND APPARATUS THEREFOR

BACKGROUND OF THE INVENTION

1. Field of the Invention

The present invention relates to a reversible thermal recording method and a reversible thermal recording apparatus therefor, and particularly to a reversible image forming and erasing method using a reversible thermosensitive recording material having a recording layer in which a color image is repeatedly formed and erased by controlling heat energy applied to the recording layer and a cooling speed after the heating, and to a reversible image forming and erasing apparatus therefor.

2. Discussion of the Related Art

Currently, hard copies are obtained, for example, by the following methods:

(1) toner images are formed and fixed on a recording material by, for example, electrophotography or the like;

(2) ink images are formed and fixed on a recording material by, for example, a printing method such as offset printing methods and ink jet printing methods, a thermal transfer recording method or the like; and (3) visible images such as dye images are formed on a recording material such as a thermosensitive recording material by, for example, a method such as a thermal recording method.

The consumption of these recording materials is rapidly increasing because copiers, facsimile machines, and printers which are used as output terminals of computers, are increasing. This causes social problems such as environmental disruption and environmental pollution. Reversible recording materials which can repeatedly form and erase images attract considerable attention because they can stop the increase of or decrease the consumption of these recording materials.

For example, transparent/opaque type reversible thermal recording materials have been disclosed which can reversibly form and erase images by achieving a transparent state and an opaque state utilizing change of light scattering properties of a polymer film in which organic crystalline particles having low molecular weight are dispersed (e.g., Japanese Laid-Open Patent Publication No. 55-154198). These transparent/opaque type reversible thermosensitive recording materials have been practically used as displays of, for example, magnetic cards and the like. However, the images formed in the displays are white images on a colored background such as black or blue, or on a light reflective background such as aluminum plates or aluminum-evaporated materials, and therefore the images are not preferable because they are very different from the images of the hard copies obtained by the methods mentioned above.

A recording apparatus which is useful for the transparent/opaque type reversible thermal recording method and in which a cooling device is provided after an image recording section is disclosed in Japanese Laid-Open Patent Publication No. 8-90934. However, this cooling device is provided only to shorten the time during which a recording layer changes from a transparent state to an opaque state. In this case, even when image erasing and forming operations are repeatedly performed and therefore the temperature of the cooling device increases, i.e., the recording layer is gradually cooled, the opaque state can be securely obtained although the cooling speed is prolonged.

Color/non-color type reversible thermosensitive recording materials (hereinafter referred to as color/non-color type recording materials) have been proposed which can reversibly form and erase color images on a white background using a composition of a leuco dye and a color developer which can reversibly achieve a colored state and a non-colored state (e.g., Japanese Laid-Open Patent Publication No. 5-124360). The coloring and decoloring of the color/non-color type recording materials can be controlled by controlling a heating temperature and a speed of cooling after the recording materials are heated. The colored state can be achieved by heating a recording layer including a leuco dye (coloring agent) and a color developer to an image forming temperature at which the leuco dye and the color developer are melted and mixed with each other, and then rapidly cooling the recording layer. At this point, if the recording layer is gradually cooled, good image density cannot be obtained. The color/non-color type recording materials are very different from the transparent/opaque type reversible thermosensitive recording materials in this respect. The non-colored state can be achieved by heating the recording layer at a temperature slightly lower than the coloring temperature.

In the transparent/opaque type recording materials, whether the recording materials achieve the transparent state or the opaque state depends on a heating temperature and does not depend on a cooling speed after the heating. Therefore, images can be recorded in a recording layer of the transparent/opaque type recording material by heating the recording layer with a thermal printhead to a relatively high temperature (an image forming temperature) for a moment, and the images can be erased by merely heating the recording layer with, for example, a hot stamp at a temperature slightly lower than the image forming temperature.

On the contrary, in the color/non-color type recording materials whether the recording materials achieve the colored state or the non-colored state depends on both a heating temperature and a cooling speed after the heating. Good color images cannot be obtained unless the recording layer is rapidly cooled after the recording layer is heated to form images therein. When reversible themosensitive recording materials are repeatedly used, new images are typically formed in the recording layer soon after former images formed therein are erased. In this case, the recording layer tends to be relatively hot when new images are formed because the recording layer is heated to erase the former images, and therefore the recording layer cannot be rapidly cooled after the new images are formed, resulting in formation of images having poor image density.

To avoid this problem, it has heretofore been considered that the recording layer of the color/non-color type recording materials has to be cooled by some method during the time between an image erasing operation and a subsequent image forming operation. If the recording layer is cooled by prolonging the time interval between the image erasing operation and the subsequent image forming operation, or by locating the image forming section far apart from the image erasing section, another problem which occurs is that it takes a long time to form new images or the image forming and erasing apparatus becomes large. There is another method for increasing the cooling speed in which a recording material is cooled with, for example, a metal plate after the image erasing operation. However, when image forming and erasing operations are continuously performed, the temperature of the metal plate increases, resulting in occurrence of the poor image density problem mentioned above.

In addition, another method is proposed in which a cooling device is provided between an image erasing section and an image forming section and in which a heating device such as a hot stamp is used as an image erasing device. In this case, when the cooling device is placed near the hot stamp which supplies high heat energy for erasing images and when images are continuously formed and erased, the temperature of the cooling device increases, resulting in occurrence of the poor image density problem mentioned above.

Further, when a cooling device is provided between an image erasing section and an image forming section, and when a recording layer is excessively cooled, relatively high heat energy is needed when images are recorded in the recording layer.

Because of these reasons, a need exists for a reversible thermal recording method which is useful for color/non-color type reversible thermosensitive recording materials and by which good images can be stably formed without applying relatively high heat energy to the recording material even when images are repeatedly recorded and erased for a long time.

SUMMARY OF THE INVENTION

Accordingly, an object of the present invention is to provide a reversible thermal recording method in which good images are repeatedly recorded and erased in a recording layer of a color/non-color type reversible thermosensitive recording material with effective and stable cooling of the recording layer, and without applying relatively high heat energy to the recording layer when recording the images.

Another object of the present invention is to provide a reversible thermal recording apparatus useful for the reversible thermal recording method mentioned above.

To achieve such objects, the present invention contemplates the provision of a reversible thermal recording method including the steps of:

providing a reversible thermosensitive recording material including a recording layer which is formed overlying at least one side of a substrate and which includes an electron donating coloring agent and an electron accepting color developer, the recording layer achieving a colored state when heated to a temperature not lower than an image forming temperature and then cooled at a speed not slower than a cooling speed (a), and the recording layer in the colored state achieving a non-colored state when heated at a temperature not lower than an image erasing temperature but lower than the image forming temperature or when heated at a temperature not lower than the image forming temperature and then cooled relatively slowly compared to the cooling speed (a);

first heating the recording layer such that the recording layer achieves the non-colored state;

then imagewise heating the recording layer such that an image of the colored state is formed in the recording layer; and then cooling the recording layer at a speed not slower than the cooling speed (a) to maintain the color image in the recording layer.

The method may further include a preliminary heating step between the first heating step and the imagewise heating step. The first heating step may serve for the preliminary heating step. In addition, the first heating is preferably zone heating of from about 1.2 to about 5.0 mm in width.

The first heating operation and the imagewise heating may be performed at substantially the same time.

In another aspect of the present invention, a reversible thermosensitive recording apparatus is provided which includes:

an image erasing device which heats the recording layer of the reversible thermosensitive recording material mentioned above so as to achieve a non-colored state;

an image recording device which imagewise heats the recording layer to form an image of the colored state in the recording layer;

a cooling device which cools the recording layer at a speed not slower than the cooling speed (a) to maintain the color image in the recording layer; and a feeding device which feeds the recording material such that the recording material is successively processed by the image erasing device, the image recording device and the cooling device in this order.

The reversible thermal recording apparatus may further include a preliminary heating device which heats the recording layer at a temperature lower than the image forming temperature, wherein the recording material is successively processed by the image erasing device, the preliminary heating device, the image recording device and the cooling device in this order. The image erasing device may serve as the preliminary heating device. In addition, the image erasing device preferably includes a resistance heater of from about 1.2 to 5.0 mm in width in a recording material feeding direction.

The image recording device may serve for the image erasing device.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Generally, the present invention provides a reversible thermal recording method including the steps of:

providing a reversible thermosensitive recording material including a recording layer which is formed overlying at least one side of a substrate and which includes an electron donating coloring agent and an electron accepting color developer, the recording layer achieving a colored state when heated to a temperature not lower than an image forming temperature and then cooled at a speed not slower than a cooling speed (a), and the recording layer in the colored state achieving a non-colored state when heated at a temperature not lower than an image erasing temperature but lower than the image forming temperature or when heated at a temperature not lower than the image forming temperature and then cooled relatively slowly compared to the cooling speed (a);

first heating the recording layer such that the recording layer achieves the non-colored state;

then imagewise heating the recording layer such that an image of the colored state is formed in the recording layer; and then cooling the recording layer at a speed not slower than the cooling speed (a) to maintain the color image in the recording layer.

In the present invention, by performing operations in the order of an image erasing operation, an image recording operation and a cooling operation, the cooling operation is hardly affected by the image erasing operation, and therefore the recording layer is stably and quickly cooled to a target temperature range. In addition, since a relatively small area including the recording layer is heated in the image erasing operation, the recording layer can be heated without heating the entire recording material, and therefore the recording material can be easily cooled to the desired temperature. Thus, the recording layer, in which an image of the colored state has been achieved, is quickly cooled to a target temperature range, resulting in formation of images having good image density. In addition, the image erasing and recording operations can be performed with a relatively small apparatus. Further, since the image erasing section and the image recording section are closely arranged in the apparatus of the present invention, the image recording operation can be performed soon after the image erasing operation. Therefore, the recording layer can be easily heated to an image forming temperature by applying relatively low heat energy because the temperature of the recording layer is still relatively high, which is caused by the image erasing operation, resulting in prolongation of the life of a thermal printhead used as the image recording device and improvement of the reliability of the apparatus.

Figure 1:
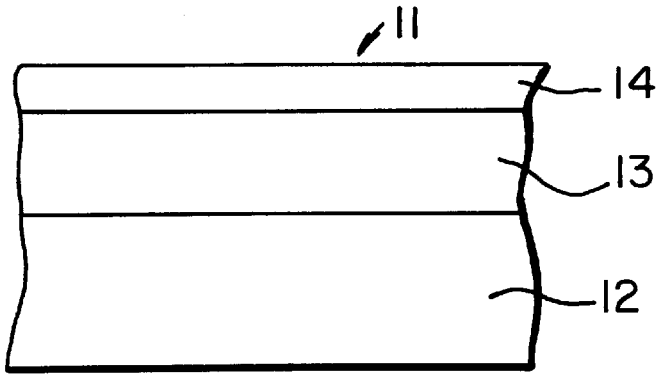
FIG. 1 is a schematic diagram illustrating a sectional view of a lee thermosensitive recording material useful for a reversible thermal recording method and apparatus of the present invention.

FIG. 1 is a schematic diagram illustrating a sectional view of an embodiment of a reversible thermosensitive recording material useful for the reversible thermal recording method and apparatus of the present invention. In FIG. 1, numeral 11 denotes a reversible thermosensitive recording material which includes a substrate 12 such as a plastic film, paper, synthetic paper or the like, a reversible thermosensitive recording layer 13 which is formed overlying the substrate 12, and a transparent protective layer 14 which is formed overlying the recording layer 13 and which prevents the recording layer from deteriorating and/or being damaged. In addition, the recording material 11 may include an undercoat layer (not shown) which is formed between the substrate 12 and the recording layer 13, and an intermediate layer (also not shown) which is formed between the recording layer 13 and the protective layer 14. Further, the recording material 11 may include a colored print layer (not shown) which is formed on a part of the protective layer 14, and a second transparent protective layer (not shown) formed overlying at least the colored print layer. The recording layer 13 includes a resin, and an electron donating coloring agent such as a leuco dye and a color developer which are dispersed in the resin.

The recording material may be a complex recording material in which a recording layer is formed on a substrate such as paper, films, cards or the like, and another substrate is adhered to that substrate. In addition, the recording material may include a photo-magnetic recording material, a photo recording material, a magnetic recording material, an IC, or the like.

Suitable leuco dyes for use in the present invention include known dye precursors such as phthalide compounds, azaphthalide compounds, fluoran compounds, phenothiazine compounds, leuco auramine compounds or the like.

Suitable color developers for use in the present invention include compounds which have both a structure capable of developing leuco dyes, such as a phenolic hydroxy group, a carboxyl group, a phosphoric acid group, or the like, and a structure capable of controlling cohesive force of the molecules thereof, such as a long chain hydrocarbon group. In the connection part of the structures in the compounds, a divalent group including a hetero atom may be included. In addition, the long chain hydrocarbon group may include a divalent group including a hetero atom or an aromatic hydrocarbon group. Specific examples of such compounds include the known color developers which are disclosed, for example, in Japanese Laid-Open Patent Publication 5-124360.

Figure 2:
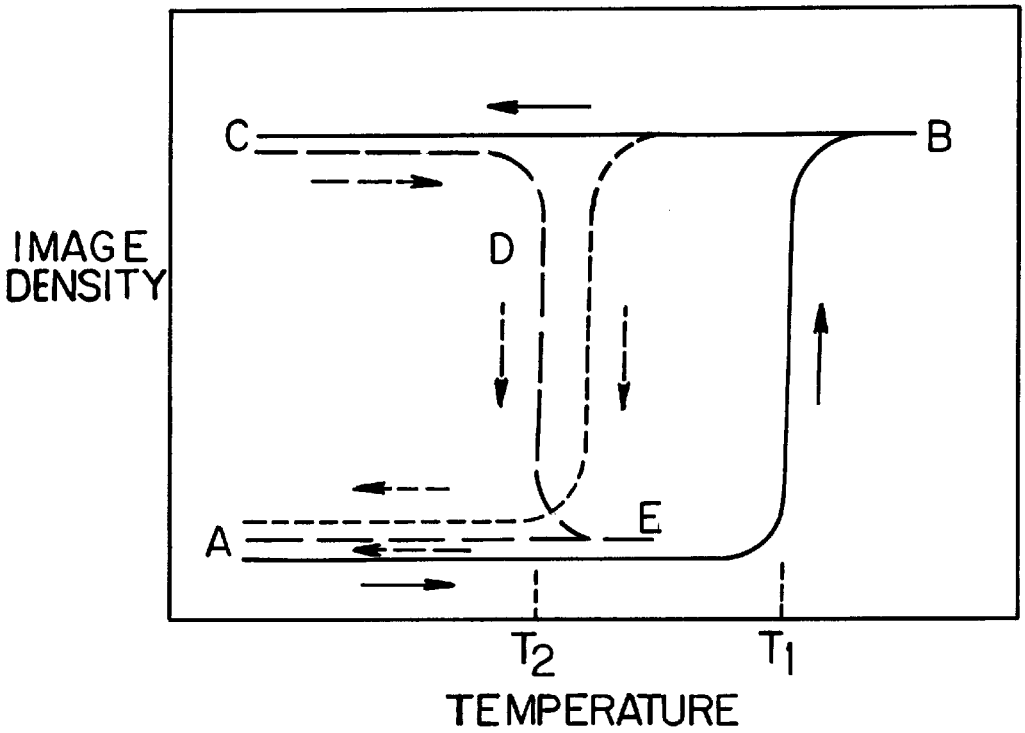
FIG. 2 is a graph illustrating the relationship between temperature and image density of a recording layer in an image recording and erasing cycle of a reversible thermosensitive recording material useful for a reversible thermal recording method and apparatus of the present invention.

FIG. 2 is a graph illustrating the relationship between temperature of a reversible thermosensitive recording material and image density thereof. When the recording material which is in a non-colored state (A) is heated, the recording material begins to color at an image forming temperature T1 at which at least one of an electron donating coloring agent and an electron accepting coloring developer is melted and then achieves a melted colored state (B). If the recording material in the melted colored state (B) is rapidly cooled to room temperature, i.e., cooled at a speed not slower than a cooling speed (a), the recording material keeps the colored state and achieves a cooled colored state (C) in which the electron donating coloring agent and the electron accepting color developer are almost solidified. Whether the recording material remains in the colored state depends upon the cooling speed. If the recording material is cooled gradually, i.e., cooled at a speed slower than the cooling speed (a), the recording material returns to the non-colored state (A) (a dotted line (B)-(A)) or achieves a semi-colored state in which the image density of the recording material is relatively low compared to the image density of the recording material in the cooled colored state (C). If the recording material in the cooled colored state (C) is heated again, the recording material begins to discolor at an image erasing temperature T2 lower than T1 and achieves a non-colored state (E) (a broken line (C)-(D)-(E)). If the recording material in the non-colored state (E) is cooled to room temperature, the recording material returns to the non-colored state (A).

In the colored state (C), it is considered that the coloring agent and the coloring developer in the recording layer form a solid in which the coloring agent and the coloring developer are mixed while interacting with each other. Namely, the coloring agent and the color developer cohere while they are reacting with each other, resulting in maintenance of the colored state. It is also considered that the colored state (C) is stable because the semi-stable cohered structure of the coloring agent and the color developer is formed. On the contrary, in the non-colored state, at least one of the coloring agent and the color developer aggregates to form a domain, or crystallizes; thereby each phase of the coloring agent and the color developer which has a stable adhered structure is isolated from the other, namely a phase separation occurs, and accordingly the recording material is stably in the non-colored state. By gradually cooling the recording layer which has been heated at a temperature not lower than the image forming temperature, the phase separation occurs and thereby the image density of the colored state decreases or the colored state changes to the non-colored state.

In the conventional transparent/opaque type reversible thermosensitive recording material in which a particulate crystalline compound having low molecular weight is dispersed in a polymer film, the image formation and erasure depend on the heating temperature and do not depend on the cooling speed after the heating operation. Therefore, the characteristic that the recording layer has to be rapidly cooled to maintain an image formed therein by imagewise heating is specific to the color/non-color type reversible thermosensitive recording material. By performing the recording method of the present invention and/or using the apparatus of the present invention, images having good image density can be formed in the recording layer of the color/non-color type reversible thermosensitive recording material. The image forming temperature (T1), the image erasing temperature (T2) and the cooling speed (a) mainly depend on the composition of the recording layer.

In the present invention, images are preferably recorded in the recording layer by imagewise heating the recording layer with a thermal printhead for a time on the order of few milliseconds. At this point, since only a small area (i.e., an image area) of the recording layer is heated for such a short time, the heat of the image area rapidly diffuses, and therefore the recording layer is rapidly cooled, resulting in formation of images having good image density. Accordingly, when the recording layer is imagewise heated to merely form images (without image erasing operation), good images can be obtained if heat energy enough to record images is applied to the recording layer.

Figure 3:
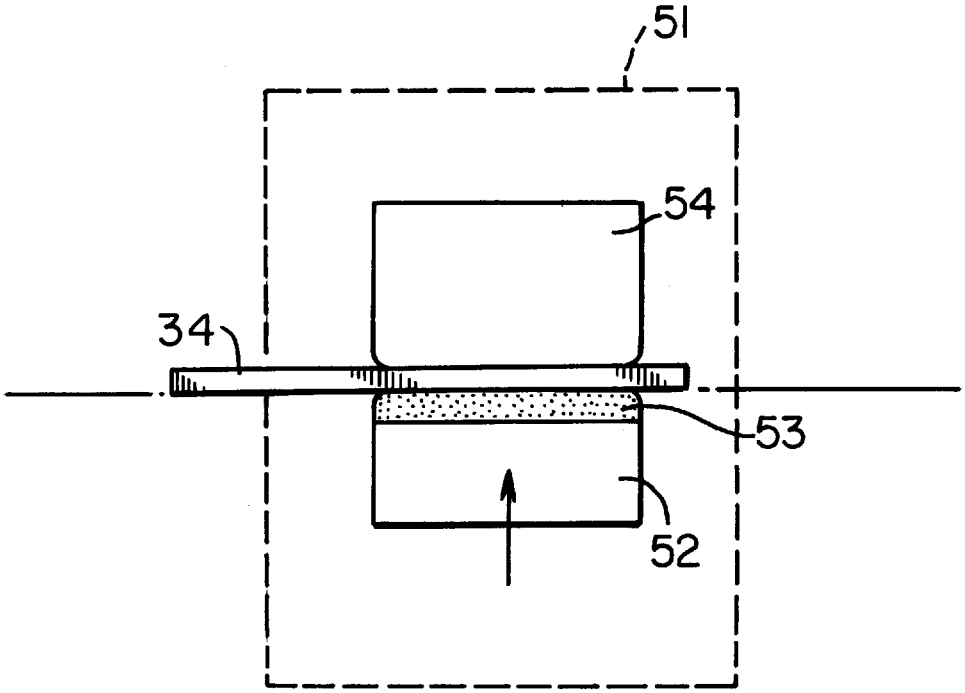
FIG. 3 PRIOR ART
FIG. 3 is a schematic diagram illustrating a typical image erasing device used for conventional reversible thermal recording methods and apparatus.

However, reversible thermosensitive recording materials are generally used such that images which have been formed in the recording layer are erased and then new images are formed therein. In addition, the image erasing operation and the image forming operation are continuously performed. In image erasing operation, the recording layer is heated at an image erasing temperature, typically, for a time of from 0.1 to 1 second. In order to erase images, for example, an image erasing device 51 as shown in FIG. 3 is conventionally used. In FIG. 3, the image erasing device 51 includes a heating element 54, such as a metal plate or a metal block, which is heated to the image erasing temperature with a resistance heater, and a pressing element 52 having an elastic element 53. A reversible thermosensitive recording material 34 is brought into contact with the heating element 54 by being pressed with the pressing element 52 (this method is hereinafter referred to a hot stamping erasing method).

When images in the recording layer are erased by the hot stamping method, a wide area of the recording material 34, including the substrate, is heated as well as the recording layer. Therefore, the recording material 34 is not rapidly cooled after the erasing operation. At this point, if images are recorded with, for example, a thermal printhead in the recording layer, which is still hot, the recorded images are gradually cooled, resulting in formation of images having poor image density.

Figure 4:
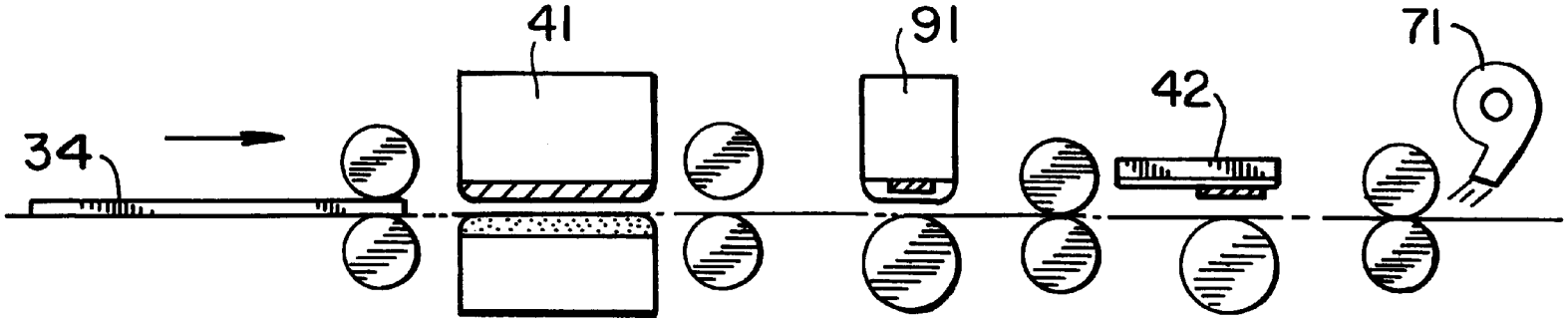
FIG. 4 is a schematic diagram illustrating an embodiment of a reversible thermal recording apparatus of the present invention.

FIG. 4 is a schematic diagram illustrating an embodiment of a reversible thermal recording apparatus of the present invention. In FIG. 4, numerals 41, 42 and 71 denote an image erasing device, an image recording device and a cooling device, respectively, and a recording material 34 in which images have been formed is fed while passing through the image erasing section, the image recording section and the cooling section to form new images in the recording material 34, and the recording material 34 is then discharged. A numeral 91 denotes a preliminary heating device, and the preliminary heating device 91 uniformly heats the recording material before the image recording operation at a temperature lower than the image forming temperature, and preferably not lower than about 40° C., in order to reduce the heating energy for recording images in the recording layer. The preliminary heating device 91 may be a ceramic heater which includes a ceramic substrate, a resistance heater formed on the ceramic substrate, and a glass protective layer formed on the resistant heater.

In the present invention, the image erasing operation and the image recording operation can be performed with one thermal printhead (so-called overwriting). In order to allow a part of a recording layer, which may be colored or non-colored, to be in a non-colored state (i.e., a non-image area), a relatively low voltage, small current or short pulse is applied to the corresponding heat elements of a thermal printhead such that the part of the recording layer is heated so as to be at a temperature lower than the image forming temperature and not lower than the image erasing temperature. On the contrary, in order to allow a part of the recording layer to be in a colored state (i.e., an image area), a relatively high voltage, large current or long pulse is applied to the corresponding heating elements such that the latter part of the recording material is heated so as to be at a temperature not lower than the image forming temperature.

Cooling devices such as cooling fans, Peltie elements, and plates, blocks or rollers of metal having good heat conductivity are conventionally used as the cooling device 71. When the cooling device 71 is provided between the image erasing device 41 and the image recording device 42 and when the entire recording material 34 is heated with an image erasing device 41, it must be cooled for a relatively long time, and in addition, the temperature of the cooling device tends to increase by continuously cooling the recording materials, resulting in gradual cooling, and thereby the image density of the resultant image decreases. As mentioned above, the conventional reversible thermal recording apparatus in which an image erasing operation, a cooling operation and an image recording operation are performed to erase a previously formed image and record a new image in a recording material has a drawback in that images having good image qualities cannot be stably obtained.

The present inventors have studied the characteristics of color/non-color type reversible thermosensitive recording materials. As a result thereof, images having good image density can be obtained by rapidly cooling the recording material, in which the images have been recorded, even when the images are recorded soon after the recording material is subjected to image erasing operation, namely even when the images are recorded while the temperature of the recording material is relatively high.

A feature of the reversible thermal recording method of the present invention is to record new images in a recording layer by performing operations in the order of an image erasing operation, an image recording operation and a cooling operation.

In conventional reversible thermal recording methods, the recording layer is heated to erase former images, and cooled to allow the recording layer to rapidly cool, and then new images are recorded in the recording layer. If the entire recording material is cooled, the recorded images are rapidly cooled and therefore good images can be obtained. However, when the erasing and recording operations are repeated, the temperature of the recording material tends to become relatively high, and therefore newly recorded images are cooled gradually, resulting in decrease of the image density of the resultant images. In addition, when the recording layer is excessively cooled, a relatively high heat energy is required to record new images.

On the contrary, in the present invention the recording material is entirely and rapidly cooled after new images are recorded therein. Therefore, the resultant images have good image density even when the erasing and recording operations are repeated. This is because the cooling section is provided at a location apart from the image erasing section, and therefore the cooling device is hardly affected by the image erasing section. In addition, when the recording material comes in to the cooling section, the heat applied to the recording material is considerably diffused, and therefore the cooling device is hardly affected by the recording material. Further, the method of the present invention has the following advantages:

(1) the size of the image erasing and recording apparatus can be minimized because a small size cooling device can be used;

(2) the recording energy of a thermal printhead can be minimized because the temperature of the recording material is relatively high, which is caused by the erasing operation performed just before the recording operation, resulting in prolongation of the life of the thermal printhead and improvement of the reliability of the reversible thermal recording apparatus; and (3) various color/non-color type reversible thermosensitive recording materials, which typically have low thermosensitivity, can be employed because the recording materials are preliminarily heated before the image recording operation, and thereby images can be recorded in the recording materials with lower heat energy than usual.

Having generally described this invention, further understanding can be obtained by reference to certain specific examples which are provided herein for the purpose of illustration only and are not intended to be limiting.

EXAMPLES

Example 1

Figure 5:
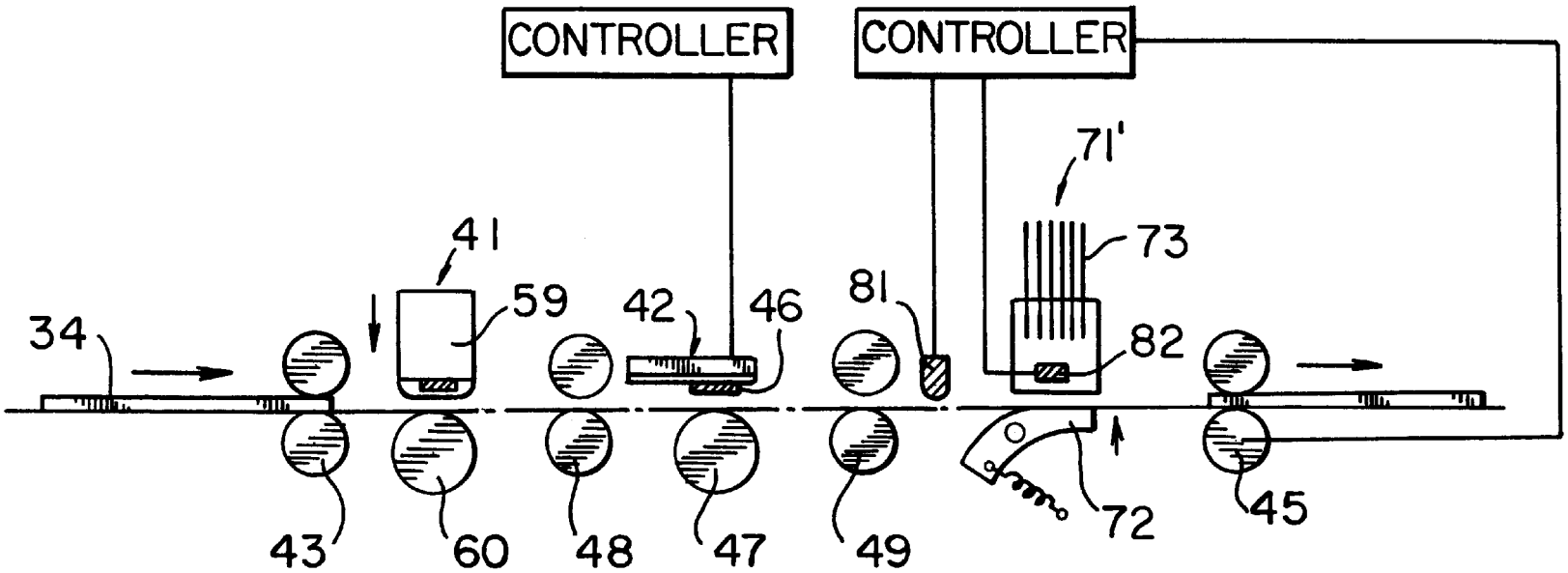
FIG. 5 is a schematic diagram illustrating another embodiment of a reversible thermal recording apparatus of the present invention.

FIG. 5 is a schematic diagram illustrating an embodiment of the reversible thermal recording apparatus of the present invention. Numerals 34, 41, 42 and 71' represent a reversible thermosensitive recording material which has images therein to be erased, an image erasing device, an image recording device and a cooling device, respectively. The recording material 34 is fed with a pair of feeding rollers 43 such that the side of the recording material 34 in which images are to be recorded is upward. The pair of rollers 43 are rotated by means of a driving device such as motors (not shown in FIG. 5). Pairs of rollers 48 and 49, which are provided between the image erasing device 41 and the image recording device 42, and between the image recording device 42 and the cooling device 71', respectively, and which are also rotated, feed the recording material 34. A numeral 45 denotes a discharge roller which discharges the recording material 34 from the apparatus. The recording material 34 is fed so that the recording material 34 is processed by the devices in the order of the image erasing device 41, the image recording device 42 and the cooling device 71'.

The image erasing device 41 has a heating mechanism. In the present invention, the hot stamping erasing device as shown in FIG. 3 which has a heating element and a pressing element can also be employed. When the heating element 54 and the pressing element 52, which have flat surfaces, are used as the image erasing device 41, the recording material 34 is preferably stopped at the image erasing device 41 to bring the recording material 34 into contact with the heating element 54 to erase the image to be erased.

The image erasing device 41 as shown in FIG. 5 which heats the recording material 34 by contacting the recording material 34 which is feeding, is more preferable. A numeral 60 represents a platen roller which faces a heating element 59 and which feeds the recording material 34. The heating element 59 presses the recording material 34 toward the platen roller 60 under predetermined pressure. The heating element 59 is provided so as to contact the recording material 34 which comes in the image erasing section. The heating element 59 may be apart from the platen roller 60 at a time other than the image erasing operation.

By using such an image erasing device, the recording material 34 is heated so that narrow regions of the recording part of the recording material 34 are effectively heated in succession for a relatively short time. Therefore, the temperature of the recording material 34 itself hardly increases and the temperature of the recording part easily decreases because the heat of the recording part tends to easily diffuse. In the cooling section, which follows the image recording section, the recording part of the recording material 34 can be rapidly cooled, resulting in formation of images having good image density.

The heating element 59 of the image erasing device 41 is shaped preferably like a belt of from about 1.2 to about 5.0 mm in width (measured in the direction of feeding the recording material 34) to effectively heat and cool the erasing part (i.e., the recording part). The heating element 59 contacts the recording material 34 such that the contact area (line) of the heating element 59 and the recording material 34 is almost perpendicular to the feeding direction of the recording material 34. In addition, by using such a heating element, the recording material 34 can easily contact the erasing element 59, and therefore the images to be erased can be uniformly erased. The width of the contact area of the recording material 34 and the heating element 59, which depends on the elasticity of the platen roller 60 and the pressure of the heating element 59, is not necessarily the same as the width of the heating element 59 and it is enough that the width of the contacting area is from about 1.2 to about 5.0 mm.

Suitable heating elements for use as the heating element 59 include ceramic heaters in which a thin film resistance heater is formed on a ceramic substrate like a belt and a glass protective layer is formed thereon. These ceramic heaters have good temperature increasing and decreasing properties. Since only the erasing part (i.e., recording part) of the recording material 34 is effectively heated with the ceramic heater when the recording material 34 comes in to the erasing section, images can be effectively erased with hardly increasing the temperature of the entire recording material 34 and the temperature of the inside of the apparatus. In addition, since the ceramic heater has a smooth surface, the recording material 34 is uniformly heated without being damaged.

The image recording device 42 includes a thermal printhead 46 and a platen roller 47. The image recording device 42 records new images in the recording material 34 in which the former images have been erased and which is conveyed to the recording section. The new images are recorded in the recording part of the recording material 34 by imagewise heating with the thermal printhead 46 the recording part, which is sandwiched between the thermal printhead 46 and the platen roller 47.

The cooling device 71' includes a cooling element which contacts the recording material 34, which is conveyed from the image recording section by a pair of feed rollers 49 and in which the new images have been formed, to cool the recording material 34. Suitable cooling elements include plates, blocks and rollers of metals having good heat conductivity such as aluminum and copper. The cooling element is provided in the apparatus so as to contact at least the recording part of the recording material 34. In order to effectively cool the recording material 34, the cooling element presses the recording material 34 by means of a pressing element 72 which is arranged so as to face the cooling element and which presses the recording material 34 using, for example, a spring. The pressing element 72 may be plate-shaped, roller-shaped or the like.

The cooling device 71' cools the recording material 34, which is fed through or stopped at the cooling section, by contacting the recording material 34 under pressure. The cooling device 71' and the pressing element 72 are preferably spaced apart from each other when the cooling operation is not performed. When the recording material 34 is fed to the cooling section, the cooling device 71' and the pressing element 72 sandwich the recording material 34 to cool the recording material 34. The surface of the cooling device 71' is preferably coated with a lubricant such as fluorine containing compounds and the like such that the coated lubricant layer hardly decreases the heat conduction from the cooling device 71' to the recording material 34.

Since the reversible thermal recording apparatus of the present invention does not apply an excessive heat energy in the image erasing operation, the temperature of the cooling device 71' hardly increases. However, the cooling device 71' preferably has a radiator 73 (cooling fins), to prevent the cooling device 71' from storing heat even when the cooling operation is continuously performed, i.e., images are continuously erased and recorded. At this point, an air blowing device 71, which blows air to the cooling fins, is preferably provided to improve the cooling effect of the radiator 73.

In order to stably record images having good image density, the temperature of the surface of the recording material 34 after the cooling operation is preferably controlled so as to be in a predetermined temperature range by detecting a temperature of the recording material 34 before the cooling operation and changing cooling conditions of the cooling operation depending on the temperature of the recording material 34. As shown in FIG. 5, a temperature detecting device 81 is preferably disposed between the recording section and the cooling section to detect the temperature of the recording material 34. If the temperature of the recording material 34 is higher than a target temperature, the cooling device 71' is directed to contact the recording material 34 for a relatively long time. Suitable temperature detectors for use as the temperature detecting device 81 in the present invention include contact type temperature detectors such as thermistors, and thermocouples, and non-contact type temperature detectors such as infrared detecting devices which detect infrared light emitted from the recording material 34 (this method is referred to as temperature controlling method 1).

Another method (this method is referred to as temperature controlling method 2) to stably control the cooling operation, i.e., a method to stably obtain good images, is to provide a temperature detecting device 82 in the cooling device 71'. The temperature of the cooling device 71' is detected with the temperature detecting device 82. The contact time of the cooling device 71' with the recording material 34 is controlled according to the temperature information of the cooling device 71' such that the contact time is prolonged when the temperature of the cooling device 71' is relatively high. When the temperature of the cooling device 71' is relatively high, the cooling device 71' may be cooled by strongly blowing air thereto with the air blowing device. Suitable temperature detectors for use as the temperature detecting device 82 include thermistors, thermocouples and the like. The temperature detecting device 82 is disposed so as to contact the cooling device 71'.

The temperature controlling methods 1 and 2 may be combined to obtain images having good image density.

The contact time may also be controlled by changing the feeding speed of the recording material 34, or by feeding the recording material 34 through the cooling section a plurality of times when the cooling speed is uniform.

Example 2

Next, another embodiment of the reversible thermal recording method using a card shaped color/non-color type reversible thermosensitive recording material 85 mm in length and 54 mm in width and the apparatus as shown in FIG. 5 is hereinafter explained.

At first, an image was recorded in the card shaped recording material 34 by applying appropriate heat energy thereto without using the image erasing device 41 and the cooling device 71'. The image density of the recorded image (black image) was 1.25 and the ground density thereof was 0.10. The image had good contrast and good visual properties.

Example 3

A heating device which was a block made of aluminum and which could heat one half area of the card shaped recording material 34 was provided in the apparatus as the image erasing device 41. The card shaped recording material 34 was fed into the apparatus and heated with the image erasing device 41 at 120° C. for 1 second to erase the image, and then a new image was recorded in the card shaped recording material 34 under the same recording conditions as those in Example 2. The interval between the erasing operation and the recording operation was 1 second. As a result, the former image was clearly erased and a new image was recorded in the card shaped recording material 34. The image density of the new image was 0.65, which was much lower than the initial image density. In order to obtain a new image having almost the same image density as the initial image density (1.25), the interval between the erasing operation and the recording operation was required to be 12 seconds.

Example 4

A cooling device which was an aluminum block 30 mm in width which had ten aluminum fins of 0.5 mm in thickness was then provided in the apparatus as the cooling device 71'. The card shaped recording material 34 was fed through the cooling device 71' at a speed of 20 mm/sec. The card shaped recording material 34 having the image was fed into the apparatus and the image erasing and recording operations performed in Example 3 were repeated (i.e., with a 1 second interval between the erasing and recording operation) except that the cooling device 71' was used. As the result, the resultant image had image density of 1.08, which was slightly lower than the initial image density but much higher than the image density of the image recorded without using the cooling device 71'.

Example 5

Then the operations of image erasing, image recording and cooling performed in the Example 4 were repeated except that the image erasing device 41 was changed to a ceramic heater having a resistance heater of 5 mm in width and the temperature of the erasing device 41 was changed to 125° C. The width of the contact area of the ceramic heater and the card shaped recording material 34 was 3.5 mm in the feeding direction. The feeding speeds of the recording material 34 at the erasing section and the cooling section were 30 mm/sec and 20 mm/sec, respectively. The former image was clearly erased and the new image had good image density of 1.15 and good visual properties.

Example 6

The operations of image erasing, image recording and cooling performed in Example 5 were repeated except that the ceramic heater was changed to a ceramic heater having a resistance heater 2 mm in width and the width of the contact area of the recording material and the ceramic heater was changed to 1.2 mm in the feeding direction.

The former image was clearly erased and the new image had good image density of 1.22, which was almost the same density as the initial image density, and good visual properties.

As described above, according to the reversible thermal recording method of the invention and the apparatus therefor, images can be clearly erased without a cooling operation after the image erasing operation, and new images, which have good image density, can be stably recorded with relatively low heat energy. In addition, the apparatus has good reliability because the life of a recording device (thermal printhead) is prolonged. This is because good images can be recorded in the recording material by applying relatively low heat energy with the thermal printhead, since the temperature of the recording material is relatively high, which is caused by the image erasing operation performed just before the image recording operation.

In the described embodiments of the method of the invention, the cooling step (after recording) is performed as a positive cooling step, involving contact of at least the recording part of the recording material with a cooling surface or medium, as distinguished from mere passive cooling effected by allowing the recording material to stand in ambient air.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 09-369173, filed on Dec. 27, 1997, the entire contents of which are herein incorporated by reference.

What is claimed is:

1. A reversible thermal recording method comprising the steps of:

providing a reversible thermosensitive recording material comprising a recording layer which is formed overlying at least one side of a substrate and which comprises an electron donating coloring agent and an electron accepting color developer, said recording layer achieving a colored state when heated at a temperature not lower than an image forming temperature and then cooled at a speed not slower than a cooling speed (a), and said recording layer in the colored state achieving a non-colored state when heated at a temperature not lower than an image erasing temperature and lower than the image forming temperature or when heated at a temperature not lower than the image forming temperature and then cooled relatively slowly compared to the cooling speed (a);

first heating the recording layer such that the recording layer achieves the non-colored state;

then imagewise heating the recording such that an image of the colored state is formed in the recording layer; and then cooling the recording layer to maintain the image in the recording layer.

2. The reversible thermal recording method according to claim 1, wherein the first heating is performed so that the recording material is heated in a zone of from about 1.2 to 5.0 mm in width in a recording material feeding direction while the recording material is feeding.

3. The reversible thermal recording method according to claim 1, wherein the first heating is performed with a fixed heating device such that the heating device contacts a surface of the recording material while the recording material is feeding.

4. The reversible thermal recording method according to claim 1, wherein the cooling is performed with a cooling device such that the cooling device contacts at least a surface of the recording material while the recording material is stationary.

5. The reversible thermal recording method according to claim 1, wherein the cooling is performed with a cooling device such that the cooling device contacts at least a surface of the recording material while the recording material is feeding.

6. The reversible thermal recording method according to claim 1, wherein the method further comprises the step of:

preliminarily heating the recording layer at a temperature lower than the image forming temperature before the imagewise heating.

7. The reversible thermal recording method according to claim 6, wherein the first heating serves for the preliminary heating.

8. The reversible thermal recording method according to claim 1, wherein the cooling step comprises the substep of:

detecting a temperature of the recording material before the cooling, and wherein the cooling is performed with a cooling device by controlling a contact time of the cooling device with the recording material depending on the temperature of the recording material.

9. The reversible thermal recording method according to claim 8, wherein the cooling step further comprises the substep of:

detecting a temperature of said cooling device before the cooling, and wherein the cooling is performed with the cooling device by controlling a contact time of the cooling device with the recording material depending on the temperature of the cooling device and the recording material.

10. The reversible thermal recording method according to claim 8, wherein the contact time is controlled by changing a feeding speed of the recording material depending on the temperature of the cooling device and the recording material.

11. The reversible thermal recording method according to claim 8, wherein the contact time is controlled by changing the number of contacts of the cooling device with the recording material depending on the temperature of the cooling device and the recording material.

12. The reversible thermal recording method according to claim 1, wherein the cooling step comprises the substep of:

detecting a temperature of a cooling device before the cooling, and wherein the cooling is performed with the cooling device by controlling a contact time of the cooling device with the recording material depending on the temperature of the cooling device.

13. The reversible thermal recording method according to claim 12, wherein the contact time is controlled by changing a feeding speed of the recording material depending on the temperature of the cooling device and the recording material.

14. The reversible thermal recording method according to claim 12, wherein the contact time is controlled by changing the number of contacts of the cooling device with the recording material depending on the temperature of the cooling device and the recording material.

15. The reversible thermal recording method according to claim 1, wherein the imagewise heating is performed with a thermal printhead.

16. The reversible thermal recording method according to claim 15, wherein the first heating and the imagewise heating are performed at substantially the same time.

17. The reversible thermal recording method according to claim 15, wherein the first heating and the imagewise heating are performed by changing at least one of a voltage, a current and a pulse width of a pulse applied to a heat element of the thermal printhead.

18. A reversible thermal recording apparatus comprising:

an image erasing device which heats a recording layer of a reversible thermosensitive recording material such that the recording layer achieves a non-colored state, said recording layer being formed overlying at least one side of a substrate and comprising an electron donating coloring agent and an electron accepting color developer, wherein said recording layer achieves a colored state when heated at a temperature not lower than an image forming temperature and then cooled at a speed not slower than a cooling speed (a), and said recording layer in the colored state achieves the non-colored state when heated at a temperature not lower than an image erasing temperature and lower than the image forming temperature or when heated at a temperature not lower than the image forming temperature and then cooled relatively slowly compared to the cooling speed (a);

an image recording device which imagewise heats the recording layer to form an image of the colored state in the recording layer;

a cooling device which cools the recording layer to maintain the image in the recording layer; and a feeding device which conveys the recording material such that the recording material is successively processed by the image erasing device, the image recording device and the cooling device in this order.

19. The reversible thermal recording apparatus according to claim 18, wherein the apparatus further comprises a preliminary heating device which preliminarily heats the recording material at a temperature lower than the image forming temperature before the imagewise heating.

20. The reversible thermal recording apparatus according to claim 19, wherein the image erasing device serves for the preliminary heating device.

21. The reversible thermal recording apparatus according to claim 18, wherein the image erasing device comprises a resistance heater of from about 1.2 to about 5.0 mm in width in a recording material feeding direction, and wherein the image erasing device heats the recording material while the recording material is feeding.

22. The reversible thermal recording apparatus according to claim 18, wherein the erasing device comprises a heater which comprises a ceramic substrate, a resistance heater formed on the substrate, and a glass protective layer formed on the resistance heater.

23. The reversible thermal recording apparatus according to claim 18, wherein the cooling device is a cooling device selected from the group consisting of metal plates, metal blocks and metal rollers.

24. The reversible thermal recording apparatus according to claim 18, wherein the cooling device comprises a radiator.

25. The reversible thermal recording apparatus according to claim 18, wherein the apparatus further comprises an air blowing device which blows air to the cooling device to cool the cooling device.

26. A reversible thermal recording apparatus comprising:

an image erasing and recording device which imagewise heats a recording layer of a reversible thermosensitive recording material such that the recording layer forms an image of a colored state and which heats an area of the recording layer other than the image such that said area of the recording layer achieves a non-colored state, said recording layer being formed overlying at least one side of a substrate and comprising an electron donating coloring agent and an electron accepting color developer, wherein said recording layer achieves a colored state when heated at a temperature not lower than an image forming temperature and then cooled at a speed not slower than a cooling speed (a), and said recording layer in the colored state achieves the non-colored state when heated at a temperature not lower than an image erasing temperature and lower than the image forming temperature or when heated at a temperature not lower than the image forming temperature and then cooled relatively slowly compared to the cooling speed (a);

a cooling device which cools the recording layer to maintain the image in the recording layer; and a feeding device which conveys the recording material such that the recording material is successively processed by the image erasing and recording device, and the cooling device in this order.

27. The reversible thermal recording apparatus according to claim 26, wherein the image erasing and recording device is a thermal printhead.

28. The reversible thermal recording apparatus according to claim 27, wherein the colored state and the non-colored state of the recording layer is achieved by changing at least one of a voltage, a current and a pulse width of a pulse applied to a heating element of the thermal printhead.

* * * * *